US007845485B2

(12) United States Patent
Honegger

(10) Patent No.: US 7,845,485 B2
(45) Date of Patent: Dec. 7, 2010

(54) METHOD AND DEVICE FOR CREATING A FLOW OF FLAT PRODUCTS IN A PREDEFINED SEQUENCE

(75) Inventor: Werner Honegger, Bach (CH)

(73) Assignee: Ferag AG, Hinwil (CH)

( * ) Notice: Subject to any disclaimer, the term of this patent is extended or adjusted under 35 U.S.C. 154(b) by 62 days.

(21) Appl. No.: 12/418,110

(22) Filed: Apr. 3, 2009

(65) Prior Publication Data

US 2009/0250311 A1 Oct. 8, 2009

(30) Foreign Application Priority Data

Apr. 3, 2008 (CH) ..... 0510/08

(51) Int. Cl.
*B65G 47/30* (2006.01)

(52) U.S. Cl. ..... 198/418.2; 198/418.1; 412/12

(58) Field of Classification Search ..... 198/418.1, 198/418.2, 644; 270/52.15; 412/1, 11, 12, 412/13

See application file for complete search history.

(56) References Cited

U.S. PATENT DOCUMENTS

| | | | | |
|---|---|---|---|---|
| 2,649,231 | A * | 8/1953 | Ferguson et al. | 198/418.2 |
| 3,718,939 | A * | 3/1973 | Mebus | 412/1 |
| 4,402,496 | A * | 9/1983 | Muller | 270/52.21 |
| 5,171,005 | A | 12/1992 | Manley et al. | |
| 5,326,209 | A | 7/1994 | Duke | |
| 5,522,587 | A * | 6/1996 | Banks et al. | 270/52.15 |
| 5,562,278 | A * | 10/1996 | Muller et al. | 198/347.1 |
| 6,952,801 | B2 * | 10/2005 | Warmus et al. | 715/251 |

FOREIGN PATENT DOCUMENTS

| | | |
|---|---|---|
| EP | 0 511 159 A1 | 10/1992 |
| EP | 1 475 329 A1 | 11/2004 |

* cited by examiner

*Primary Examiner*—James R Bidwell
(74) *Attorney, Agent, or Firm*—Rankin, Hill & Clark LLP

(57) ABSTRACT

The invention relates to a method and to a device for creating a product flow according to a predefined sequence (S). The products (A, B, C) are fed from different feed flows of a grouping path (G) and there, according to the sequence (S), are deposited onto a conveyor (10, 10) with a closed revolving path (U). According to the invention a repair function is realised in which the products (A, B, C) are then only transferred from the conveyor to a further-processing station if the sequence (S) is correct and all products (A, B, C) are present with the desired quality. Otherwise, the products (A, B, C) are led by the continuously operated conveyors (A, B, C) back to the grouping path (G). Here, the error is corrected by way of the deposition of the missing product (A, B, C), whilst the deposition of new products (A, B, C) is interrupted. For error correction, one may previously provide a discharge of a defect or wrong product (A, B, C). After the error correction, the creation of the product flow is continued by way of the sequentially correct deposition of further products (A, B, C). The method permits the error-free and sequentially correct creation of infinitely long and infinitely assembled sequences (S).

15 Claims, 4 Drawing Sheets

METHOD AND DEVICE FOR CREATING A FLOW OF FLAT PRODUCTS IN A PREDEFINED SEQUENCE

BACKGROUND OF THE INVENTION

1. Field of the Invention

The invention lies in the field of conveyor technology and processing technology of flat products, in particular of printed products such as newspapers, periodicals and magazines. It relates to a method and to a device for creating a flow of flat products in a defined sequence or succession, in particular with the purpose of further-processing in this defined sequence. A preferred application is in mailroom technology, on putting together, and, as the case may be, addressing different products in a defined sequence in accordance with a predefined sequence of addresses, which for example corresponds to a mailing route.

2. Description of Related Art

In mailroom technology, different products must be put together in a manner which is assigned to the addressees, and addressed, as the case may be, and grouped into groups (e.g. as small stacks). The background of this is the fact that as a rule, different products must be dispatched in a set number to certain addresses, wherein the addressees must be sought in a certain succession (mailing route). Hereby, there is the demand that at least one, or generally each product, which is envisaged for a certain addressee, is individualised with the address concerned.

For this reason, there exists the need to set up the complete product flow already in the defined sequence, before the products are processed further. A further-processing may include the addressing of all or selected products and/or the formation of groups/stacks, as the case may be, before or after packaging individual products or product groups. A sequence of products of the type A, B, C, . . . for example may be as follows: AAABBCCCCCAAABBBC . . . , wherein the first three exemplars of product A, the first two exemplars of product B and the first five exemplars of product C for example are envisaged for a first addressee, the next four exemplars A, three exemplars B and one exemplar C are envisaged for a second addressee, etc. The sequence may also look as follows: (ABC)(ABC)(AB)(AC)(BC), wherein in each case products collated on top of one another are indicated by brackets. Such products are assigned to one end product or addressee, for example the products may be individualised supplements, which are inserted into a newspaper in a further processing step. A printer arranged after the sequence creation may then, for example, print the addresses correct to sequence, and the products may be subsequently grouped into groups and/or stacks correct to sequence and be delivered according to a defined mailing route (sequence of receivers).

The products may be present in the product flow in an individual manner or completely or partly overlapping. It is often necessary for at least a part of the product surface to be accessible for a subsequent addressing of all products.

An incorrect or missing product leads to the fact that the product sequence is shifted and thus the subsequent steps, in particular the addressing according to an address list, no longer match. Even without a subsequent addressing, an error may lead to the fact that a product succession is present, which is no longer correct with regard to sequence, in particular with regard to the mailing route. As a whole, one desires to avoid, as much as possible, a propagation of the error caused by an incorrect product sequence, in the subsequent processing steps.

EP-A 0 511 159 describes a method as well as a corresponding device which serves for composing more complex products by way of inserting part-products into a main product. Thereby, different products supplied as continuous flows are led together into groups on at least one grouping path, realised by way of conveyor belts. Each group is to have a defined sequence of products. In order to avoid errors in the deposited product flow on account of errors in the supply, it is suggested to buffer the products already in supply flow, before release to the grouping path, e.g. by way of suitable intermediate conveyors. The release is to be effected only when an adequate number of products for creating a complete group are present in all buffers. As the case may be, the creation of a group is delayed until this is the case. Thereby, one accepts the fact that the deposited product flow has gaps. This however is not a problem, since here it is not the case of a composition of an infinitely long product flow, which is correct with regard to the mailing route, and moreover, also does not address.

A similar method is known from EP-A 1 475 329. Here, several products are prepared simultaneously and deposited as a finished part-imbricate formation, instead of individually depositing the products. Likewise, only sections (short product sequences) are processed, without addressing the products.

The known methods are above all envisaged for composing printed products out of several part products, for example for manufacturing pamphlets or books from several kerfs, or for inserting different supplements into folded newspapers. Hereby, it is always the case of groups with a relatively small product number, for which the necessary intermediate storage means may be realised without great effort. However, larger intermediate storage means are required for creating longer sequences, in order, as the case may be, to be able to buffer all products which are to be released one after the other, until this release. The known method is therefore not suitable for creating infinitely long sequences, in particular with a large number of equal products in a part sequence (group), without any design adaptation of the applied device.

Moreover, according to the state of the art, one may only avoided errors on release of the products to the grouping path. An error in the created product flow may not be corrected and thus may likewise lead to sequence errors with the further-processing.

BRIEF SUMMARY OF THE INVENTION

It is therefore the object of the invention to provide a method and a device for creating a product flow in a predefined sequence, with which the disadvantages mentioned above are avoided, and in particular errors may be corrected also after the release of the products from the feeds. In particular, it should be possible for each individual product to be at least partly accessible for the purpose of further-processing, in particular for the purpose of addressing, and for the sequence of the further-processing and the sequence of the products, to be brought into agreement.

This object is achieved by a method and a device with the features of the independent claims. Advantageous further formations are to be deduced from the dependent claims, the description and the drawings.

For creating a product flow according to a predefined sequence, the products from different feed flows are led to a grouping path and there are deposited according to the sequence onto a conveyor with a closed revolving path, for example in an individual manner, or as small groups or in a partly overlapping manner. According to the invention, a repair function is realised in that the products are transferred from the conveyor to a further-processing station, only when the sequence of the deposited products is correct and all products are present with the desired quality and in the desired sequence. In the case of error, e.g. also with an error in the feed, which leads to a gap in the deposited flow, the products are fed as a part product flow by the continuously operated conveyer back to the grouping path, whilst the deposition of new products is interrupted. Here, the error is corrected by way of depositing the missing product. A discharge of a damaged or wrong product may be provided prior to this for the correction of the error. After the error correction, the creation of the product flow is continued by way of a sequentially correct release of further products. The method permits the error-free creation of infinitely long and infinitely assembled sequences.

"Sequence" in the context of the invention means for example:

Products that are laid down in a predetermined order one after the other and without overlap, e.g. products of the type A, B, C in a sequence of the form AAABBCCCCCAAAAABBBBC . . .

Products that are laid down one after the other and, as the case may be, on top of one another, e.g. a sequence (ABC)(ABC)(AB)(AC)(BC). . . . The brackets indicate that the corresponding products are placed on top of one another; groups formed like this are arranged one after the other in the conveying flow.

In order to ascertain whether the sequence of the products in the product flow corresponds to the predefined sequence, the system is preferably monitored at least one suitable location, e.g. downstream of a grouping path and/or at the respective release position and/or directly before the transfer to the further-processing station. After detection of an error, the release of new product from the feed flows to the conveyor is interrupted, as the case may be with a time delay, without interrupting the movement of the conveyor. The products which have already been deposited on the conveyor are now no longer released to the further-processing station at least from after an error location corresponding to the error, but in a repair mode are led back along the closed movement path back to the grouping path (repair procedure/repair run-through/repair mode). The gap which thus arises in the released product flow is accepted. It is not a problem since the further-processing, as the case may be, may also be accordingly interrupted.

The interruption of the product feed to the grouping path, although resulting in the fact that the creation of the product flow is interrupted at a particular location within the sequence during the repair run-through, however the creation of the sequentially correct product flow is however continued again at a later point in time, preferably at exactly this location directly subsequent to the error-corrected "repaired" part flow, thus in a gapless manner. In this manner, the correct sequence of the products on release to the further-processing is ensured independently of the length of the sequence to be created.

The device according to the invention includes a plurality of feed units for the products, and a conveyor with a closed revolving path for conveying the created product flow. The controllable feed units release the products at several release positions lying one after the other along a grouping path, to the conveyor. A controllable release unit arranged along the movement path of the conveyor in the region of the transition between the conveyor and the further-processing station, serves for selectively releasing the product flow from the conveyor to the further-processing station or for conveying it further along a closed movement path, so that it may be fed back to the grouping path. A control unit is present for controlling the participating components. This, preferably, receives status information or error notices of the participating components. A detecting unit is present, e.g. a light barrier, a camera or another optical or mechanical sensor, which is preferably arranged downstream of the grouping path along the movement path, for detecting errors in the created product flow, in particular a gap or a damaged product or a wrongly collated group of products placed on top of one another, and for its notification to the control unit.

The control unit preferably also communicates with the further-processing station. The control unit, for example, informs when the product release from the conveyor to the further-processing station is interrupted on account of a repair run-through or is taken up again subsequent to this. With this, the further-processing may likewise be interrupted as the case may be, e.g. an addressing module may be stopped until products arrive again.

The dispensing unit, for example, is realised by a mechanical diverter or by elements which effect a condition change (open/closed) of grippers which are present as the case may be, for the purpose of product release or further conveying.

The device is preferably operated in a cycled manner, wherein all components, in particular the feed units and, as the case may be, also the further-processing, are subjected to the same cycle. A cycle corresponds for example to a certain advance of the conveyor, e.g. to the length of a receiver compartment measured in the conveyor direction.

The invention has the advantage that one may realise a repair function without a great design effort, with which errors in the deposited product flow may be corrected at a later stage, but before the release to the further-processing. The products are deposited in the predefined sequence until an error has been ascertained. Only then is the sequence creation interrupted, as the case may be, with a time delay, and the part sequence intermediately stored on the conveyor in the repair mode is subjected to an error correction from after the error location up to the last product before the interruption. After the error correction, the sequence is continued again by way of the release of new products, wherein the first new product preferably is directly subsequent to the last product of the error-corrected sequence.

Infinitely long sequences may be created in an error-free manner with the invention, without the feeds or buffer units which, as the case may be, are present there, having to be enlarged. The release is not effected in groups, but is only interrupted with an error. If despite this, one desires a mechanical separation of the product flow which per se is continuous, into individual groups, then empty locations may be programmed into the sequence, which leads to deliberately missing products in the product flow which for this reason do not trigger a repair run-through.

A further advantage lies in the fact that the conveyor may be operated in a continuous manner and does not need to be stopped, so that time losses and energy losses as well as a mechanical loading of the system are avoided. It is only the condition of the release unit which must be changed in a controlled manner.

The invention in particular permits the creation of a sequence of individual printed products or product groups which are assigned to different receivers, said sequence being configured in accordance with the mailing route. The addressee is to be sought in a predefined sequence, and the products must therefore be present in this sequence. The products are, for example, grouped together after or in the further-processing, into stack units and delivered in this manner.

BRIEF DESCRIPTION OF THE DRAWINGS

Examples of the invention are represented in the drawings and are described hereinafter. In a purely schematic manner, there are shown in.

DETAILED DESCRIPTION OF THE INVENTION

Figure 1A:
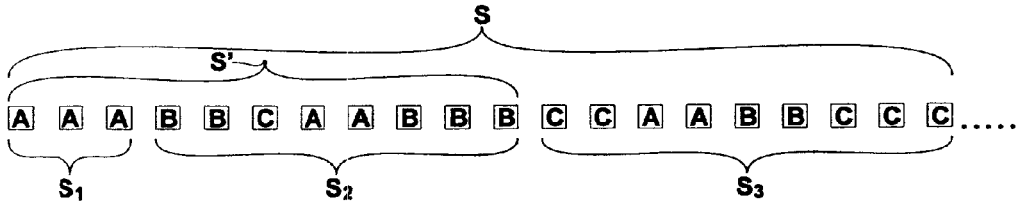
FIG. 1*a-f* the course of the method according to the invention.

FIG. 1*a-f* schematically shows the construction of the device according to the invention and the sequence of the method according to the invention. FIG. 1*a* shows an example of a cut-out of a sequence S of products to be created. The sequence here, by way of example, comprises three different products A, B, C in a different number, here for example from the left to the right: 3×A, 2×B, 1×C, 2×A, 3×B, 2×C, 2×A, 2×B, 3×C . . .

This example concerns a sequence of products A, B, C which are to be laid down one after the other as single products. The same principle is applicable for the case in which the sequence comprises small groups, e.g. (ABC), (AB), of products placed on top of one another. In this case the control of the feed units (time of product release) is adjusted in such a way that the products are not placed one after the other, but on top of one another.

The products A, B, C originate from a product feed 50 with three product sources $Q_A$, $Q_B$, $Q_C$, which at release positions $P_A$, $P_B$, $P_C$ run out into a grouping path G. The connection in the feed flows between the product sources $Q_A$, $Q_B$, $Q_C$ and the grouping path G may be selectively interrupted or created. The controllable feed units used for this are symbolised by switches $S_A$, $S_B$, $S_C$. The products A, B, C are transferred to a conveyor 10 by the feed units, said conveyor being moved along the grouping path G along a closed revolving path U in the conveyor direction F. The product sequence is created with the predefined sequence S by way of releasing the products A, B, C in a manner which is controlled according to the sequence S.

A detection device 20 which is capable of detecting the set sequence or errors therein is located downstream of the grouping path G in the conveyor direction F. A controllable release unit 30, which is likewise symbolised by a switch, is arranged downstream of the detection device 20. It may influence the product flow or the conveyor 10, such that the product flow is selectively discharged from the conveyor 10 and is led to a further-processing station 40, or is conveyed further by the conveyor 10 along a revolving path U.

The product feed 50 optionally comprises a buffer 52, in which the products A, B, C may be intermediately stored before the product release to the grouping path. Irregularities in the feed of the products from the respective sources may be compensated and controlled in a targeted manner by way of this. The sources $Q_A$, $Q_B$, $Q_C$ may be suitable product storage means, e.g. stacks or windings, or be the exit of a station arranged beforehand, e.g. printer, stitching module.

The feed unit $S_A$, $S_B$, $S_C$, the release unit 30 and the further-processing station 40 are controlled by a control unit 60. The control unit 60 for this transmits corresponding control signals to these units. The control unit 60, moreover, receives status information, i.e. information with regard to the type of detected product, or an error notice, e.g. absent or defect product, from the detection unit 20. In the first case, by way of comparison with a sequence known to it, for example stored as a list, the control unit 60 itself may determine deviations which must be corrected. In the second case, the control unit may determine the type of missing product as well as the error location in the formation from the error notice. If it is necessary to correct the error, the control unit 60 initiates a repair run-through which is described below with reference to FIG. 1*c-f*.

Instead of, or additionally to the detection unit 20, one may also transmit status information or error information from the feed units $S_A$, $S_B$, $S_C$ or the further-processing station 40 to the control unit 60. This then, as the case may be, may initiate a repair run-through or another suitable operating mode of the device (e.g. storing the products given a failure of the further-processing by way of a renewed circulation without new product feed). The control unit 60 may also interrupt the feed of products from the feed units $S_A$, $S_B$, $S_C$.

Figure 1B:
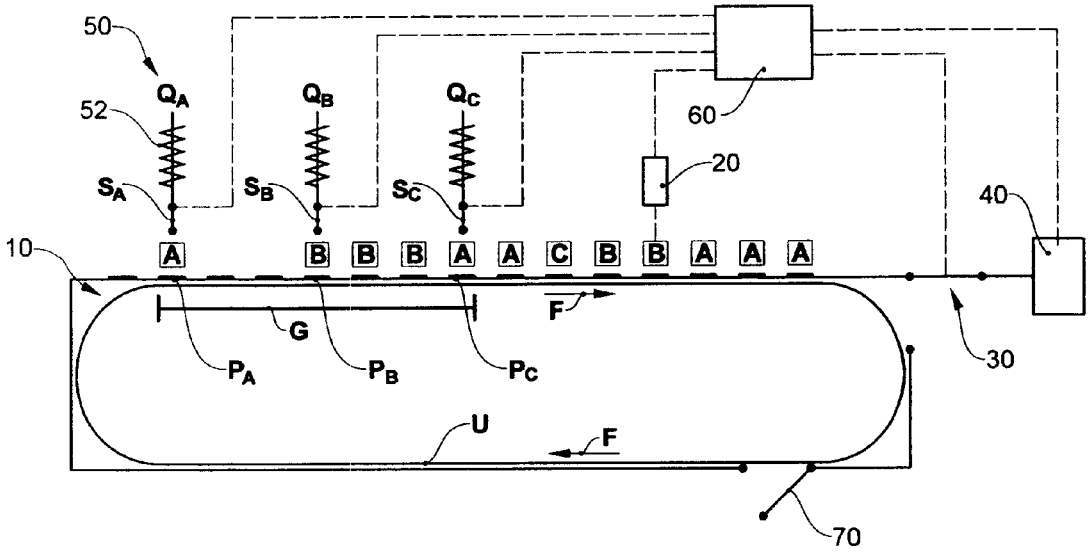

The normal formation of a product flow from individually conveyed products with a predefined sequence is explained by way of FIG. 1*b*. A momentary picture is shown in FIG. 1*b*, in which a first part sequence S' of the sequence S has already been completely set up, as well as the first product of the type A of the remaining sequence $S_3$ has been transferred to the conveyor 10. The two products C between this are still absent, since the product flow has not yet passed the respective release position $P_C$ for the product type C. The detection unit 20 controls the product sequence running past in its detection region. Since this corresponds to the predefined sequence, the release device 30 remains in the release mode, in which the product flow is transferred to the further-processing 40. The conveyor 10 moves independently of the condition of the release device 30 in a continuous manner (cycled or uncycled) along the closed revolving path.

Figure 1C:
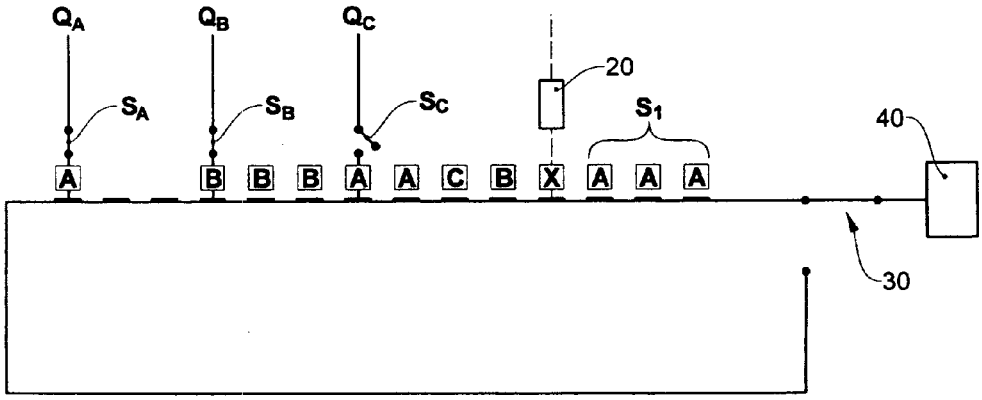

FIG. 1*c* shows the same momentary picture as in FIG. 1*b*, but with the difference that the first part sequence S' has an error which here is represented by an X at the location of the second product B. X may be a wrong, a defect or an absent product. Since X is located in the detection region of the detection unit 20, this now sends an error signal to the control unit 60.

Figure 1D:
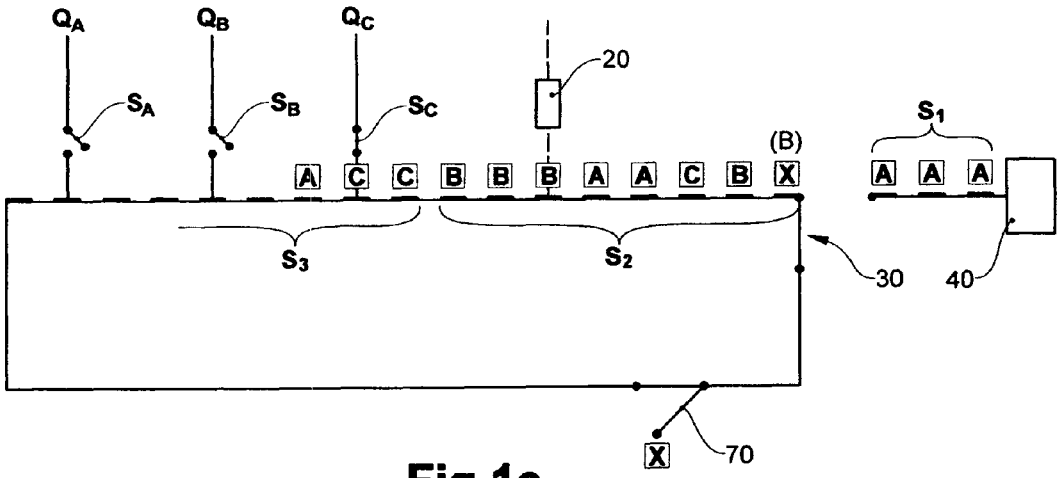

As FIG. 1*d* shows, the control unit 60 initiates the following: the condition of the release device 30 is changed at or before the point in time at which the error X reaches the transfer location. The products which are located downstream of X, here the part flow with the part sequence $S_1$=AAA, are still transferred to the further-processing 40. From after the error location X, the product flow with the part sequence $S_2$ is left on the conveyor and is fed again to the beginning of the grouping path G. As a further measure, the release of new products is interrupted, so that the remaining part sequence $S_3$ for now is not yet created. The interruption does not need to be effected directly on detection of an error, but a part sequence $S_2$ to be repaired, may in principle be continued at its end, until the beginning of this part sequence runs into the grouping path G or reaches the respective release position for the missing product. The length of the part sequence to be repaired is therefore directed, for example, to the available number of conveyor departments of the conveyor or according to the total length of its conveyor surface. It is also possible for the buffer 52 to yet be completely emptied and any gaps in the deposited product flow to be filled with the repair run-through. Likewise, the further-processing 40 may be informed and as the case may be, interrupted, when it too must process the products in the correct sequence and at the correct point in time.

Figure 1E:
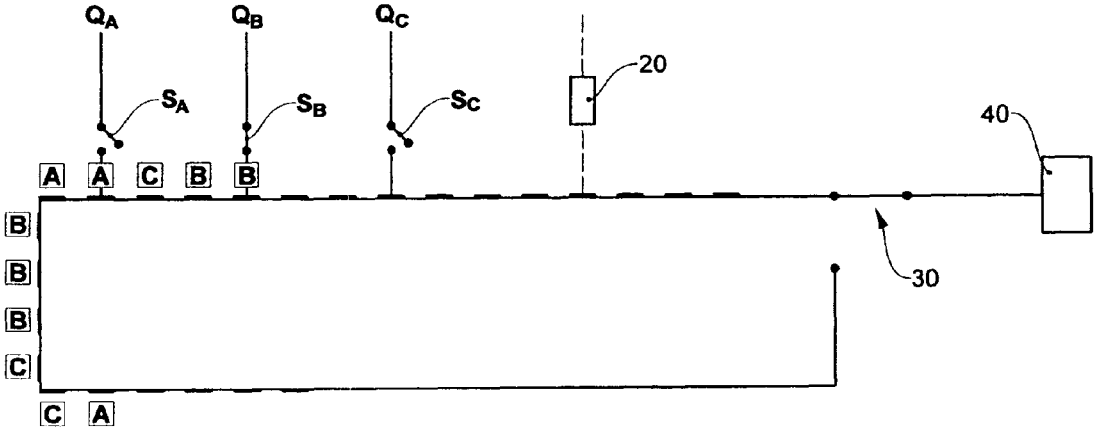
Figure 1F:
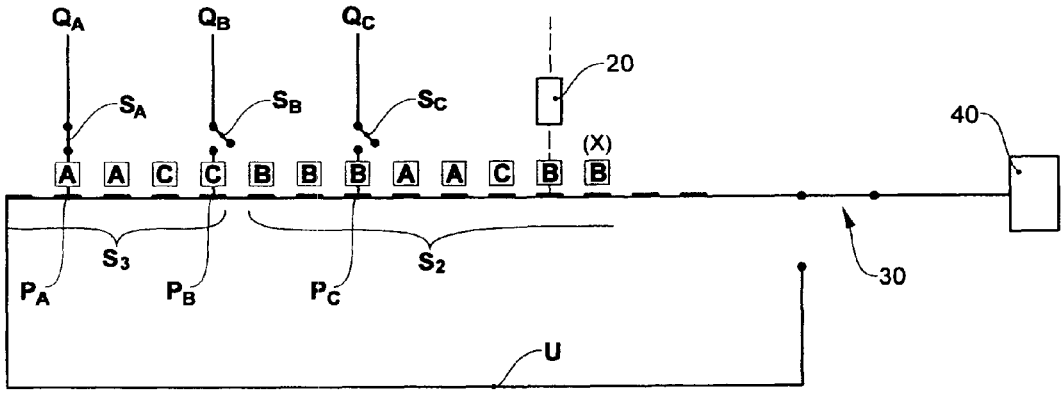

Here, a product B should have been deposited at the error location X according to the sequence. The leading error-free part sequence $S_1$ is discharged, and the part sequence S2 to be repaired remains on the conveyor. If, with regard to the error X, it is the case of a product, it may be discharged at a controllable discharge 70, which is arranged along the movement path U, so that the product flow has a real gap. The remaining part sequence $S_2$ with the beginning of the remaining sequence $S_3$ runs in the repair mode again into the grouping path G and is supplemented in a sequentially correct manner by the missing product B at the release position $P_B$ (FIG. 1*e*). After the end of the repaired part sequence $S_2$ has passed the release position $P_A$, the sequence S is continued with the remaining part sequence $S_3$ (FIG. 1*f*). The corrected part sequence $S_2$ and all following products are released to the further-processing 40 until the detection of a further error. In the further-processing, the products, although arriving with a gap to the previously released part sequence $S_1$, the predefined sequence is however ensured at all events. The sequence is correct with regard to the further-processing, and here one may work off an address list without any sequential error.

In each case, one or more products A, B, C may be released one after the other at the release positions $P_A$, $P_B$, $P_C$. As previously shown, the release may be such that the products may come to lie on the conveyor next to one another and separated from one another, or come to lie partly overlapping, whilst forming an imbricate formation. Thus in the further-processing, one may have individual access to the products or at least to product parts, e.g. for printing on an address. In the case that an individual further-processing is not necessary, e.g. because only the uppermost product of a stack must be provided with an address, the products may also be deposited on one another.

Figure 2A:
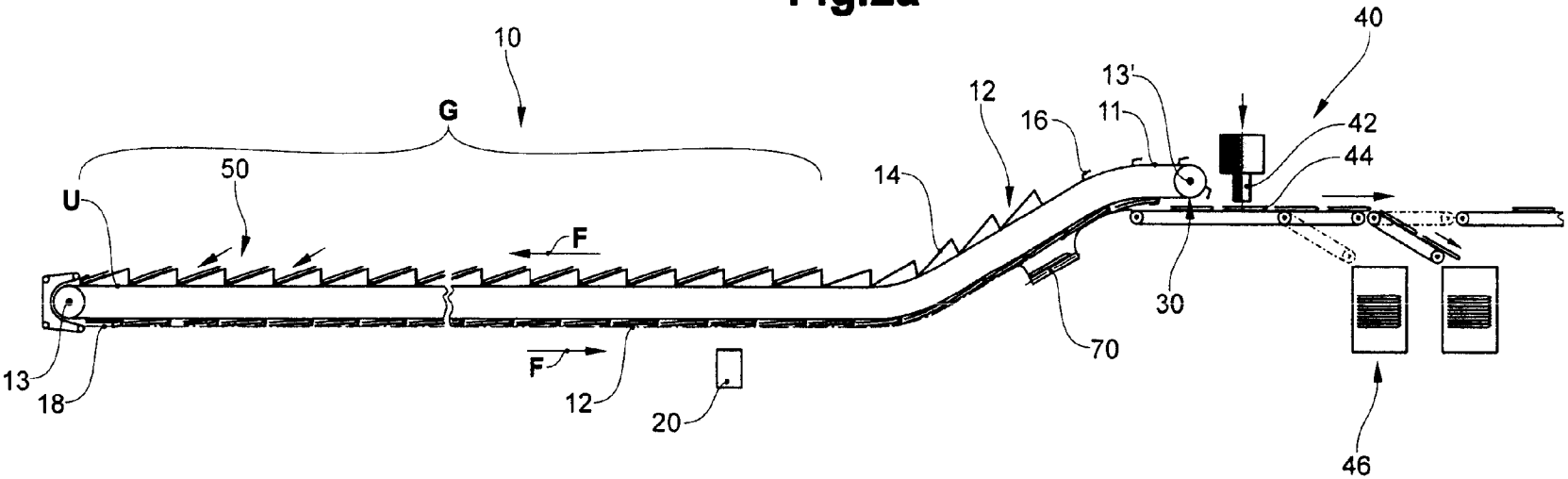
FIGS. 2*a* and 2*b* a device according to the invention, with a grouping path, in a lateral view and in a plan view.
Figure 2B:
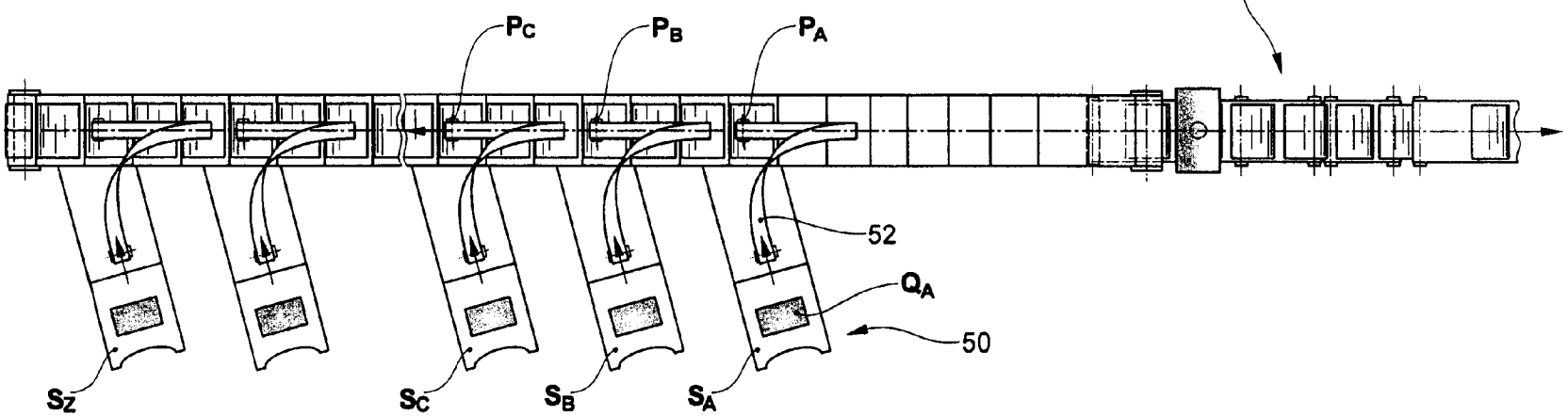

FIGS. 2*a*+*b* show two different views of a device according to the invention. This comprises the above described components, in particular a conveyor 10, a feed 50 with several feed units $S_A$, $S_B$, $S_C$, . . . , $S_Z$, a detection unit 20, a release unit 30 and a further-processing 40.

The basic construction and the function of the conveyor 10 are described in the application PCT/CH2007/000373 which has not been published beforehand. Here, it is only described to the extent as is necessary for understanding the invention. PCT/CH2007/000373 is referred to in a supplementary manner.

The conveyor 10 has a plurality of conveyor compartments 12 which are separated from one another, whose length is somewhat larger than a typical product length and which are moved with a conveyor means 11 led over two deflections 13, 13' along a longitudinally extended closed movement path U with two roughly parallel sections. The conveyor compartments 12 in the horizontally running upper part of the moment path U have an obliquely running rear wall 14, which serves as a bearing surface for the products and may be realised for example by way of a suitable deflection of the pull means. The rear wall 14 is pivotable, set up in the upper part and is orientated roughly horizontally in the horizontally running lower part of the movement path U. A clamping element 16 is located in the region of each conveyor region 12 which leads in the conveyor direction. The products in the upper part of the movement path U bear on the rear walls 14, wherein the clamping element 16 serves as an abutment, with which the leading product edges are aligned and may be fixed as the case may be. A support conveyor belt 18 is arranged parallel to the movement path U in the lower part of the movement path U, in which the compartments are orientated upside down.

The products in the upper part of the movement path U along the grouping path G are introduced by the feed units into the compartments 12. After passing the left deflection 13, the products are conveyed upside down. Thereby, they are held by clamping elements 16 in the conveyor compartments 12. One prevents the free product ends from hanging down by way of a support conveyor belt 18 arranged below the compartments 12. The products are towed in the conveyor direction to the deflection 13' on the further-processing side. The clamping elements 16 in the region of the deflection 13' on the further-processing side are opened in normal operation and by way of this are transferred to the further-processing 40, here are deposited onto a conveyor belt 44.

The clamping elements 16 in repair operation are not opened, so that the products run around the deflection 13' on the further-processing side, and subsequently are led back again to the grouping path. The controllable release device 30 is provided for switching between the two operating types. It is realised for example by way of a switchable cam guide which may act on the clamping element 16. Depending on the condition of the cam guide, the clamping elements 16 are either opened or left in the closed condition, on passing the guide. The switching-over may be effected in a very rapid manner and also in a very accurate cycle frequency, even with a high cycle frequency.

The controllable feed units $S_A$, $S_B$, $S_C$, . . . , $S_Z$ may be designed in a manner known per se, e.g. as in the initially mentioned EP-A 1 475 329. The feed units in each case comprise an intermediate conveyor 52 which may act as a buffer and prepares the products for the purpose of a quick release. The intermediate conveyor 52 has a movement path which is bent in a bow-like manner. This permits the product sources to be arranged laterally of the conveyor 10 and to feed the products obliquely from above in the movement direction F of the conveyor 10.

The discharge of defect products in the discharge unit 70 may likewise be realised by way of controllable guides, which selectively open the clamping elements on passing, so that the product concerned falls out and may be disposed of.

The further-processing station here is shown as an addressing unit with a printer 42. A predefined address sequence is worked away for example. After the addressing, the products are, for example, transferred to a stapling module in a sequentially correct manner or are conveyed further for the purpose of further-processing, e.g. foiling, binding.

Figure 3A:
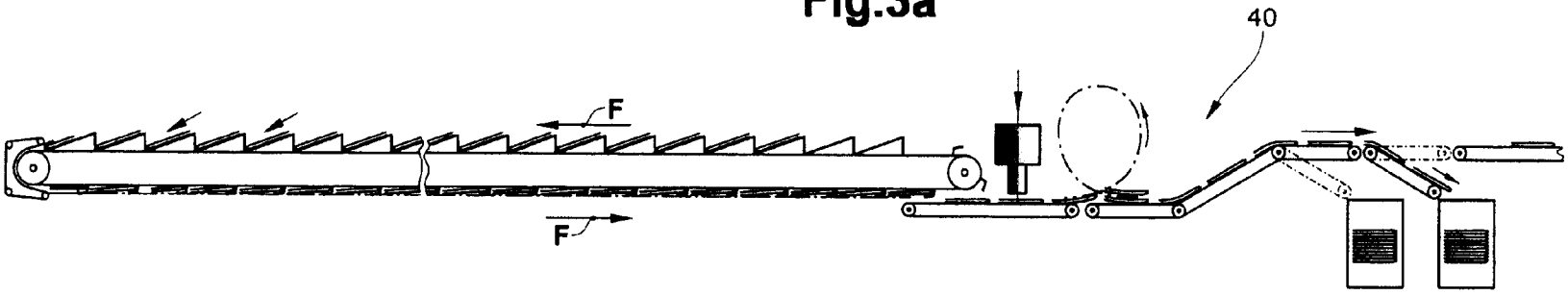
FIGS. 3*a* and 3*b* a device according to the invention, with two grouping paths, in a lateral view and plan view.
Figure 3B:
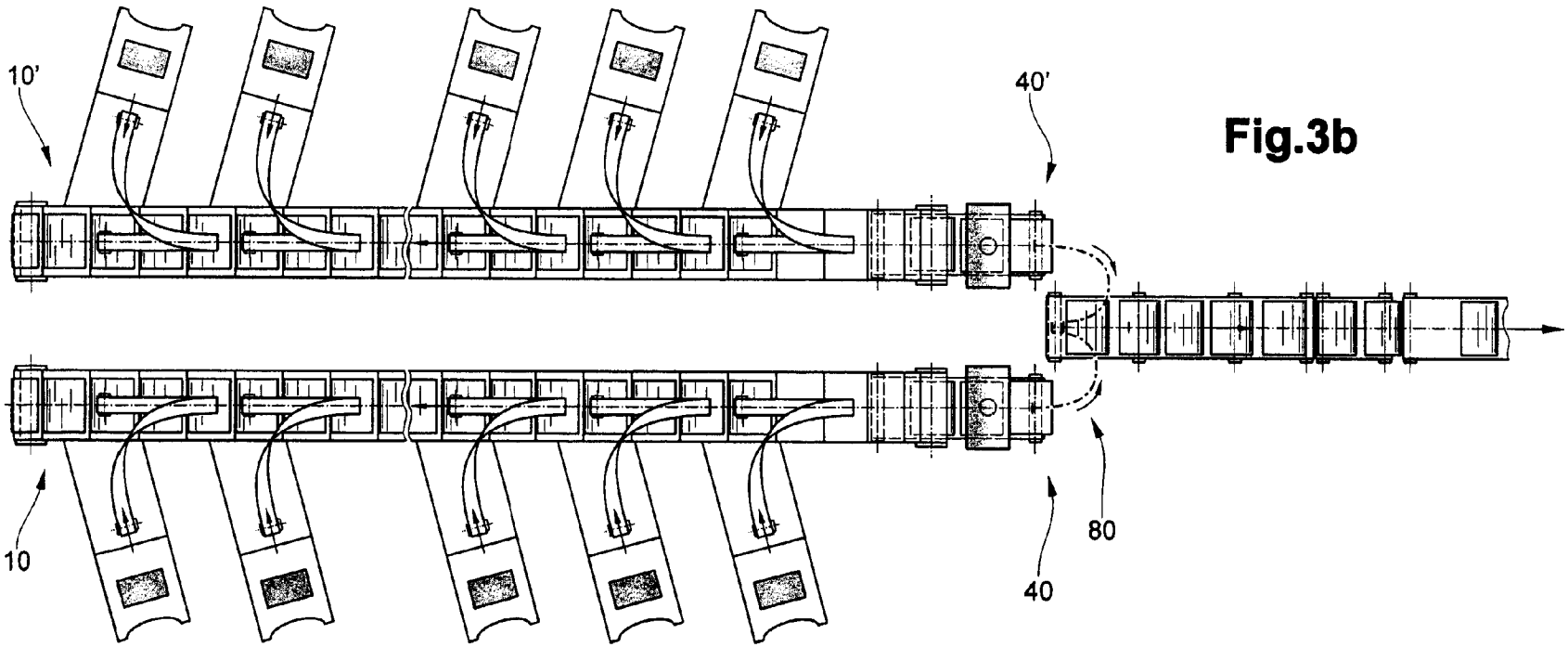

FIGS. 3*a*+*b* show one variant of the device of FIGS. 2*a*+*b* with two conveyors 10, 10' with in each case several feed units, two further-processing stations 40, 40' and a merging unit 80, which merges the product flows from both branches. Respective modules for merging two product flows are known per se, e.g. from WO 2007/071084 and may be applied here.

The device with the two conveyors 10,10' serves for the parallel creation of part product sequences, which are again combined into a common product flow in a sequentially correct manner. By way of the parallel instead of sequential creation of the part sequences, one may accommodate more feed stations 50, without increasing the length of the return path (i.e. of the revolving path U) of each individual conveyor 10, 10'. By way of this, one prevents the duration for a repair run-through increasing with the number of the feed stations 50. By way of doubling the further-processing stations 40, one may also deal with limitations due to their processing capacity. More complex sequences with more diverse products may be created. Alternatively, also partly equal products may be supplied to the different stations, in order to increase the performance of the complete installation.

Instead of two further-processing station 40, a common further-processing unit 40 may also be present, which is arranged downstream of the merging unit 80.

The further processing can also comprise inserting groups of products placed on top of one another in a folded further printed product.

The invention claimed is:

1. A method for creating a flow of flat products, in particular printed products, in a predefined sequence, comprising the steps of providing at least one conveyor having at least one conveying element which is moved continuously along a closed revolving path, wherein the revolving path comprises at least one grouping path;

providing several feed flows of products, wherein release positions of the feed flows lie one after the other along the at least one grouping path;

releasing the products coming from the feed flows at the release positions to the at least one conveyor;

moving the products with the conveyor to a further-processing station, monitoring the created sequence to detect errors;

transferring only those products whose sequence corresponds to the predefined sequence to the further-processing station;

wherein the following steps are carried out in case of detection of an error at an error location within the created sequence:

interrupting the release of new products from the feed flows to the conveyor, without interrupting the movement of the conveyor;

conveying the products located on the conveyor, at least from after the error location back to the grouping path; and releasing the product or products necessary to correct the sequence while the created erroneous sequence passes the grouping path again.

2. A method according to claim 1, further comprising continuing the release of products from the feed flows to the conveyor when the error-corrected sequence has left the grouping path.

3. A method according to claim 1, further comprising monitoring the sequence of the products as to whether it corresponds to the predefined sequence and/or to whether defect products are contained, and discharging products which are located at the wrong location or which are defect.

4. A method according to claim 3, further comprising providing a detection unit that is capable of carrying out the monitoring step;

providing feed units for feeding the products in the feed flows to the conveyor;

providing a controllable release unit for the transfer of the products from the conveyor to the further-processing station;

providing a control unit that is capable of controlling the feed units and the release unit transferring a control signal to the control unit by means of the detection unit, on detection of an error;

wherein the control unit by way of transmitting further control signals to the feed units, interrupts the release of products from the feed flows, and by way of transmitting further control signals to the release unit, prevents the transfer of the products to the further-processing station, so that the conveyor supplies the product flow containing the error back to the grouping path, and by way of transmitting further control signals initiates selected feed units for the sequentially correct release of the missing product or products.

5. A method according to one claim 1, comprising the steps of supplying the products of the feed flows from a product source and transferring the products into a buffer before releasing them from the buffer to the conveyor.

6. A method according to claim 5, comprising the steps of interrupting the release of products from the feed flows to the conveyor with a time delay after the detection of an error, in particular by way of emptying the buffer before interrupting the release of products.

7. A method according to claim 1, comprising the step of controlling the product release from the feed flows to the conveyor by a control device, which initiates the release of the products in dependence of the sequence to be created, in a predefined number and at a predefined point in time.

8. A method according to claim 1, comprising the step of depositing the products one after the other, individually or on top of one another, into conveyor compartments of the conveyor, which are separate from one another.

9. A method according to claim 1, comprising the step of printing addresses according to a predefined address sequence onto the products released by the conveyor, wherein the further-processing station is an addressing station.

10. A device for carrying out the method according to claim 1, with a plurality of feed units for the products and with at least one conveyor with a closed revolving path for receiving and conveying the created product flow, wherein the feed units are capable of releasing the products at several release positions lying behind one another along at least one grouping path, to the conveyor, further comprising a controllable release unit with which the product flow may be selectively discharged out of the conveyor or may be fed back to the grouping path.

11. A device according to claim 10, further comprising a control unit which is capable of activating the feed units and the release unit.

12. A device according to claim 10, further comprising a detection unit for detecting errors in the product flow.

13. A device according to claim 10, wherein the revolving path of the conveyor comprises two sections, which are arranged above one another, wherein the grouping path is located within the upper section of the movement path, and the release unit for transfer to the further-processing station is located in the movement direction at a front end of the lower section.

14. A device according to claim 10, wherein the conveyor comprises a plurality of conveyor compartments which are separate from one another, are moveable one after the other along the closed revolving path, and onto which the products are deposited or into which the products are introduced.

15. A device according to claim 10, wherein at least two conveyors and feed units assigned to these, and a merging unit for bringing together the part product flows created on the conveyors, are present.

* * * * *